US005428363A

United States Patent [19]

D'Hont

[11] Patent Number: 5,428,363

[45] Date of Patent: Jun. 27, 1995

[54] ANTENNA SYSTEM FOR USE IN AN AUTOMATIC VEHICULAR IDENTIFICATION SYSTEM

[75] Inventor: Loek D'Hont, Almelo, Netherlands

[73] Assignee: Texas Instruments Incorporated, Dallas, Tex.

[21] Appl. No.: 127,860

[22] Filed: Sep. 28, 1993

[30] Foreign Application Priority Data

Sep. 28, 1992 [GB] United Kingdom ..... 9220413

[51] Int. Cl.[6] ..... H01Q 11/02; H01Q 7/00; H01Q 9/02

[52] U.S. Cl. ..... 343/742; 343/867; 343/876; 340/572

[58] Field of Search ..... 343/742, 741, 866, 867, 343/744, 870, 711, 876; 340/572; H01Q 11/02, 7/00, 9/02

[56] References Cited

U.S. PATENT DOCUMENTS

| | | | |
|---|---|---|---|
| 2,965,188 | 12/1960 | Hanysz | 343/711 |
| 3,588,372 | 6/1971 | Jauquet | 343/711 |
| 3,979,091 | 9/1976 | Gagnon et al. | 343/711 |
| 3,991,485 | 11/1976 | Golenski | 35/11 |
| 4,680,717 | 7/1987 | Martin | 364/436 |
| 4,806,943 | 2/1989 | Doncel | 343/742 |
| 4,963,880 | 10/1990 | Torre et al. | 343/866 |
| 5,084,710 | 1/1992 | Whittington | 343/867 |
| 5,126,749 | 6/1992 | Kaltner | 343/742 |

FOREIGN PATENT DOCUMENTS

| | | |
|---|---|---|
| 0414628 | 2/1991 | European Pat. Off. . |
| 462055 | 1/1977 | United Kingdom . |
| 2235337 | 2/1991 | United Kingdom . |

*Primary Examiner*—Donald Hajec
*Assistant Examiner*—Hoanganh Le
*Attorney, Agent, or Firm*—James C. Kesterson; Richard L. Donaldson

[57] ABSTRACT

An antenna system for use in an Automatic Vehicle Identification (AVI) system 10 having a plurality of non-resonant antenna loops 14 which operate as a single loop antenna during a transmit cycle and individual antenna during a receive cycle. The antenna system includes individual antenna 14 each having amplifier 29 connected to a single source. A switch circuit selectively switches the system from a transmit to receive mode and from a receive to a transmit mode.

5 Claims, 3 Drawing Sheets

ANTENNA SYSTEM FOR USE IN AN AUTOMATIC VEHICULAR IDENTIFICATION SYSTEM

BACKGROUND OF THE INVENTION

This invention relates to an antenna system for use in, for example, registration and identification applications.

One example of a typical registration and identification system is an automatic vehicle (AVI) system. The AVI system is used to monitor vehicles for various applications such as for example motorway toll charging, speed monitoring, access to restricted areas of only certain vehicles, crime prevention, etc. The AVI system typically includes a transponder on the vehicle, for example the transponder described in our co-pending application number S/N 08/127,910 (TI-16812); and an antenna system for monitoring the transponder and to register the relevant information relating to the vehicle on which the transponder is mounted. Two typical systems are described in our U.S. Patent No. 5,351,052 (TI-17341) and our co-pending application Ser. No. 08/127,680 (TI-16817). In AVI systems for monitoring motorway traffic there are potentially many vehicles approaching at any one time. If, for example, the system is being used for motorway toll charging it is important that each vehicle is accurately identified and the relevant information stored. For this type of application, it is necessary to have multiple antennas covering the area. Generally, each of the antenna comprise a tuned Loop or LC Circuits. The antennas and feeder cables typically need to be constructed of litze wire and are designed such that the inductivity of the antenna is about $27\mu H \pm 1\mu H$.

The close proximity of two antennas can cause dead zones in the area to be covered. Forming a multiple antenna of tuned antennas would produce an over critical coupled series of tuned LC networks which could result in detuning of the individual antennas and heavy damping. Obviously this would mean that the system is not capable of registering and identifying all transponders in the field of view of the antennas. The problems caused can, to some extent, be overcome by critical on-location antenna pretuning to ensure that the resonant dead zones are minimized. This can be time consuming, costly and inconvenient.

An auto-tuning system for a tuned antenna system has been used to solve the problem of tuning-on-location and detuning due to metal objects by adding circuitry. This solution is expensive due to the complex circuitry required.

One object of the present invention is to provide an antenna system which overcomes at least some of the disadvantages of known systems.

SUMMARY OF THE INVENTION

According to one aspect of the present invention, there is provided an antenna system comprising a plurality of non-resonant antenna loops arranged such that the plurality of antennae act as a single large charge-up loop antenna during a transmit cycle and act as individual antennas during a read cycle.

BRIEF DESCRIPTION OF THE INVENTION

Reference will now be made, by way of example, to the accompanying drawings, in which.

DETAILED DESCRIPTION OF THE INVENTION

Figure 1:
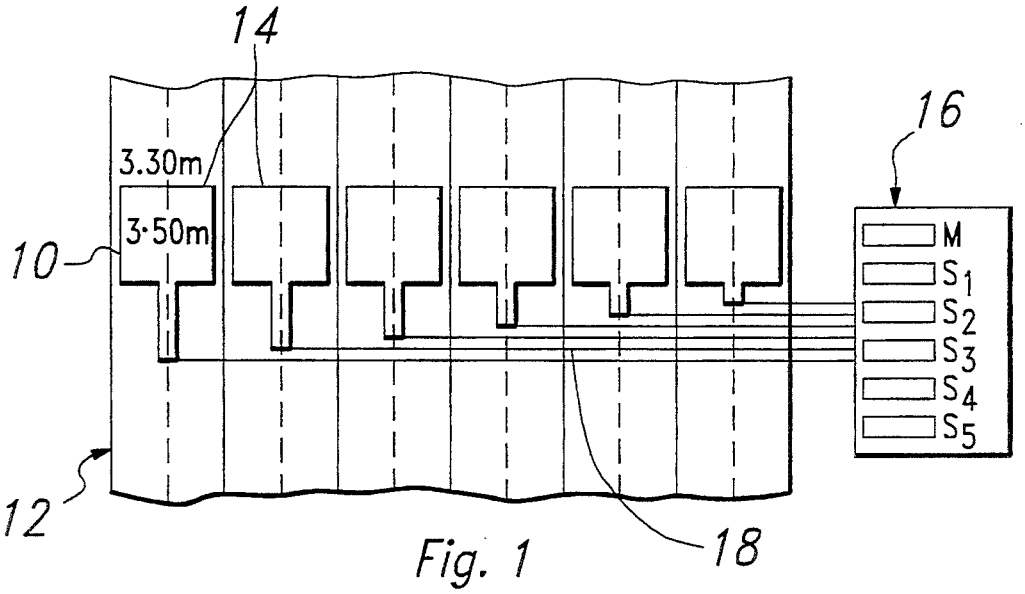
FIG. 1 is a diagram of an example of an antennas system according to one aspect of the present invention.

Referring to FIG. 1, the interrogation portion of a recognition and identification system is shown generally at 10. The system as shown is for use with an automatic vehicle identification system, but other systems are equally applicable. In the example shown, the interrogation portion of the system is used to identify vehicles on a six lane highway 12. Each lane of the highway has an antenna 14 associated therewith, which antenna is used to transmit and receive signals capable of determining whether a vehicle is carrying a transponder, and for identifying vehicles which are carrying transponders. The antennas 14 are linked to a reader box 16 by respective feeder cables 18. Typically the antenna are square loops of about 3.3 m by 3.5 m, one associated with each lane of the highway.

Figure 2:
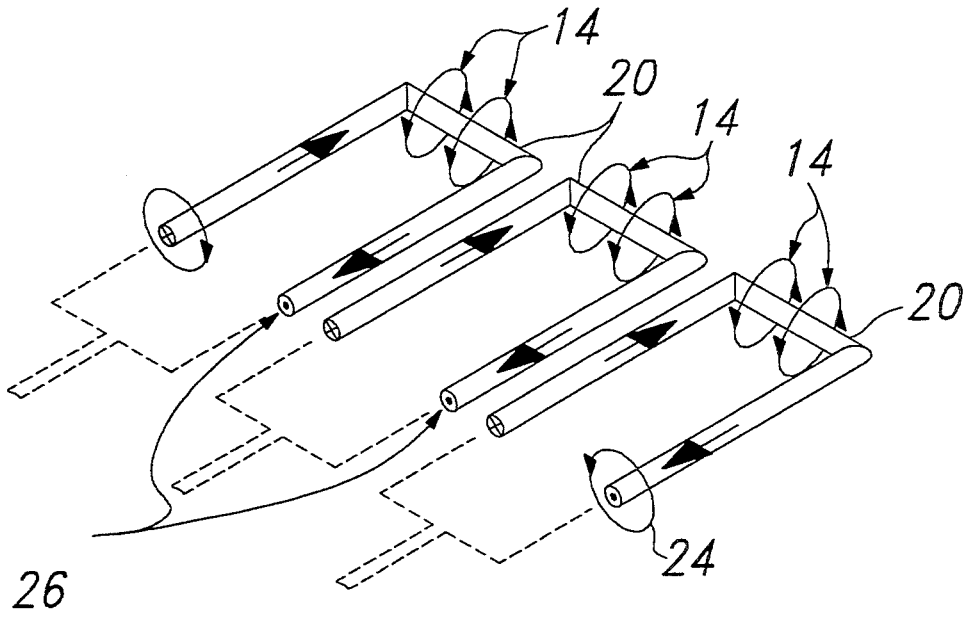
FIG. 2 is a diagram of an antennae configuration for the system of FIG. 1 for example.

FIG. 2 shows three of the antennae in more detail. The antenna 14, 14' and 14'' are adjacent non-resonant loops that are fed by non-resonant HF amplifiers (not shown in FIG. 2). One of the amplifiers is however, shown in FIG. 3. The field lines 20 add in areas where the field generated by each loop is parallel, i.e. at 22 and cancel out in the areas where the field lines 24 of respective antennae run in opposite directions, i.e. at 26.

Figure 3:
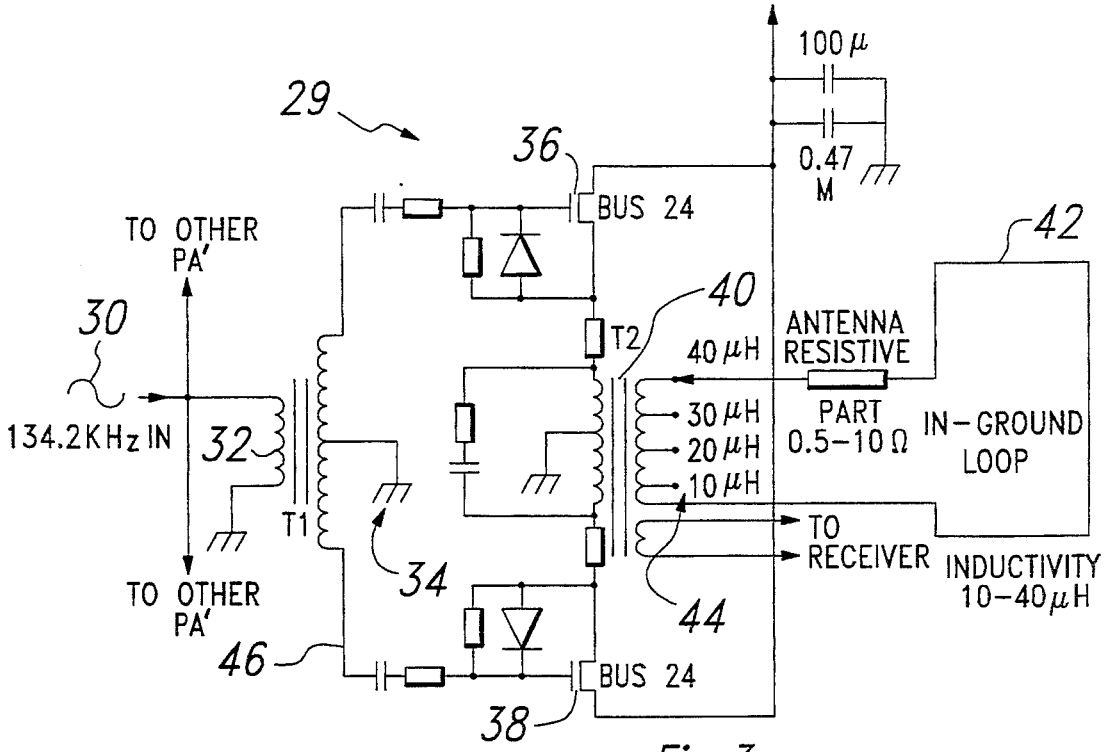
FIG. 3 is a circuit diagram of an amplification stage for each antenna of the FIG. 2 configuration.

Referring to FIG. 3, each amplifier 29 is a class A-B power amplifier formed from push-pull source followers, providing a simple, low-distortion power amplifier, Class A or Class A-B power amplifiers are generally of low efficiency but make very good drivers. For this application therefore, Class A or Class A-B amplifiers are ideal.

A sine wave 30 is input on the HF of a transformer 32. In the present case the sine wave has a frequency of about 134.2 kHz although this may be varied as required. The transformer 32 is a step up transformer which generates a high voltage on section 34 of the amplifier circuit. This high voltage is converted in to the low impedance output of emitter followers 36 and 38.

This low impedance output is then used by transformer 40 to drive the antenna 42. The voltage provided to the antenna is typically around 300V peak to peak. The antenna impedance is provided between 10 and 40 $\mu H$ by connecting the required point 44. The antenna 42 is an in-ground loop antenna and includes a resistive element of about 0.5 to $10\Omega$.

The amplifier also includes a counter balance circuit 46 which counter balances the impedance in the loop. This ensures that there are not heavy loses in the amplifier and also improves the Q-factor of the amplifier.

FIG. 3 illustrates the mode of operation of the circuitry during antenna transmit cycles. Each antenna will transmit an investigation signal which is received by an appropriate transponder. The transponder will to some extent change the signal and return it to the antenna. The change in the signal is used to identify the unique nature of each transponder. Each change will be readable by the antenna to enable information regarding the transponder to be read and stored as appropriate.

For multiple antenna configurations as in FIG. 1, the individual amplifiers (one for each loop antenna) all run from the same sine wave source, which creates phase synchronous signals on all individual antennas. This allows antennas to be close together, as is shown in FIGS. 1 and 2, without the problems that would normally occur using tuned antennas. FIG. 2 shows the field distribution of the adjacent antennas sections. The phase and current area of such a nature (same current, 180 degree phase shifted) that the fields cancel each other in the areas 26 of the antenna system. In this way, the while antennas row built up from individual loop antennas, acts as a giant charge-up loop, with the same performance of one loop, having the outer dimensions of the whole stack formed by the individual antennas.

This creates a continuous field with no dead spots covering the lanes of the highway or any other area on which the system is used. The antennas are adapted to both transmit as described above and receive as will be explained in more detail below.

This ability to transmit and receive forms part of the interrogation cycle of the system. The receive part of the interrogation cycle includes the steps transport, telegram, transmit.

Figure 4:
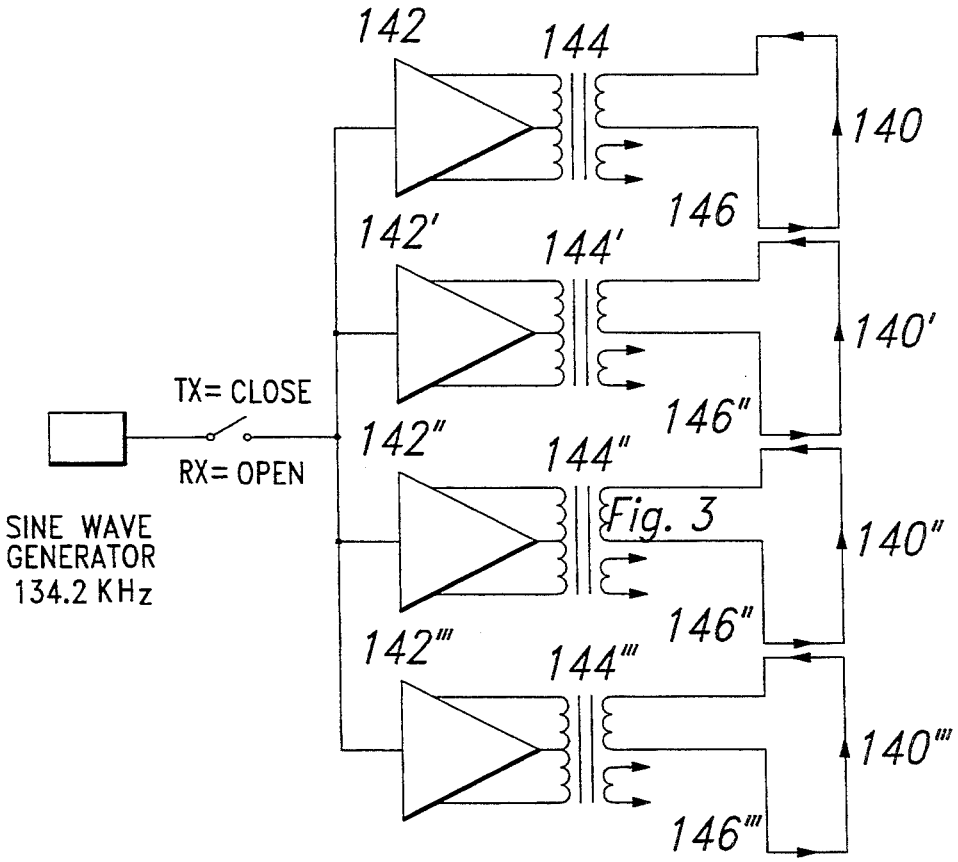
FIG. 4 is a block diagram of a 4-loop transmission part of the antenna system.

Referring to FIG. 4, the Readout set up is shown. Four antennas 140, 140', 140'' and 140''' are shown, as are associated driving amplifier of each 142, 142', 142'' and 142'''. Any signal received by the antennae will be fed back to the drive transformers 144, 144', 144'' and 144''' and be detected by the receiver transformer loops 146, 146', 146'' and 146'''. The detected information is then processed and stored so that the information transmitted by the transponder can be used for its required purpose.

Figure 5:
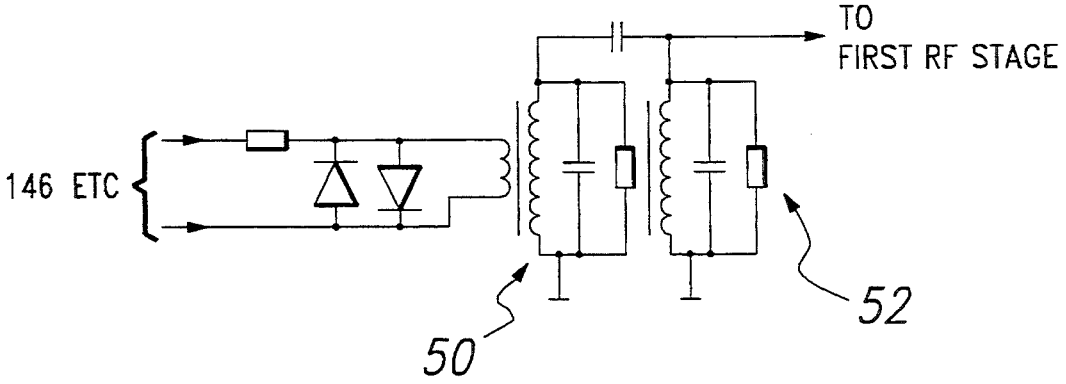
FIG. 5 is a block diagram of the receiver end for one part of the 4-loop transmission of FIG. 4.

The loops 146, 146', 146'' and 146''' are connected to the receiver front end circuits as are shown in FIG. 5. A low-bit and high-bit frequencies are determined by the receiver filters 50, 52. The former is low-bit tuned to about 122 kHz and the latter is highbit tuned to about 134.2 kHz. The pass frequency of the system is determined by these filters and not the antenna.

Since the antennas are not tuned, it is easy to switch the antennas using, for example, MOSFETs during transition form transmit to receive and vice-versa, therefore offering system flexibility in terms of RF multiplexing if needed. This is because the additional resistance to the network introduced by the MOSFET's on-resistance has virtually no effect for the untuned antenna system.

Another very important advantage of the above over-tuned equipment is the fact that a damping circuit (to damp away the power pulse at the beginning of receive cycle for tuned interrogation systems) is not needed. The un-tuned nature of the antennas of the present invention makes the field drop from maximum to zero in the region of microseconds.

Antenna tuning is also unnecessary for the receiver. The untuned loop is hookedup to the receiver, and as previously indicated, the low-bit and high-bit frequencies are determined by the receiver filters, not the antenna.

The circuitry shown is only one example of possible implementation of the system the skilled man will identify alternative arrangements which fall within the scope of the invention. This system avoids the whole concept of tuned antennas, so no complex circuitry is necessary.

Other advantages offered by this system include the following which have been described in detail above.

Long feeder cables being usable and not diminishing the performance of the system;

RF electronic switching (multiplexing) possible without performance loss;

Adjacent loop antennas allowed;

No dead zones in the charge-up field due to configuration and untuned nature of the antennas;

No litze-wires required;

Antenna impedance not critical for either transmit and receive;

The phase of each antenna is always the same as would be expected since the stability does not depend on antenna tuning; and No noise sensitivity during telegram receive due to multiple loops.

This system is usable in, for example, Automatic Vehicle Identification applications, but may be used in all recognition and identification applications that require readout coverage over a large area.

What is claimed is:

1. A transmit/receive antenna system for use with a registration and identification system having a signal source comprising:

a plurality of adjacent non resonant transmit/receive antenna loops connected to said registration and identification system, and extending across or substantially normal to at least two adjacent and parallel pathways, each one of said loops associated with a single pathway, each one of said loops laying in the same selected plane and each one of said loops including a normal portion extending normal to said pathway and first and second parallel portions extending parallel with or in substantially the same direction on said pathway, and where one of said loops is adjacent another one of said loops, such adjacent loops being located such that a first portion of one loop is located alongside a second portion of an adjacent loop;

a switching means for selectively switching said registration and identification system from a transmit to receive mode and from a receive to transmit mode; and said signal source connected to each of said first and second portions of each of said plurality of antenna loops such that the field lines generated by each antenna loop are additive for said normal portions of adjacent antennas and such that the field lines first portion parallel to a second portion cancel each other so that said plurality of antenna loops act as a single large charge-up loop antenna during a transmit cycle and act as an individual antenna during a receive cycle.

2. The antenna system of claim 1, wherein each antenna loop is driven by an associated amplifier.

3. The antenna system of claim 1, wherein the switching means comprises a MOSFET device.

4. The antenna system of claim 1 wherein said registration and identification system is an automatic vehicle identification system and said selected pathway is a roadway.

5. The antenna system of claim 1 wherein said signal source is a sine-wave source such that phase synchronous signals are created at each of the individual antennas.

* * * * *